US011499381B2

(12) United States Patent
Bargach et al.

(10) Patent No.: US 11,499,381 B2
(45) **Date of Patent: *Nov. 15, 2022**

(54) DATA TRANSMISSION SYSTEM

(71) Applicant: ISODRILL, INC., Houston, TX (US)

(72) Inventors: Saad Bargach, Bellville, TX (US); Stephen D. Bonner, Sugar Land, TX (US); Madhusudhan Nagula, Sugar Land, TX (US)

(73) Assignee: ISODRILL, INC., Houston, TX (US)

( * ) Notice: Subject to any disclaimer, the term of this patent is extended or adjusted under 35 U.S.C. 154(b) by 12 days.

This patent is subject to a terminal disclaimer.

(21) Appl. No.: 17/071,735

(22) Filed: Oct. 15, 2020

(65) Prior Publication Data

US 2021/0040842 A1 Feb. 11, 2021

Related U.S. Application Data

(63) Continuation-in-part of application No. 16/532,246, filed on Aug. 5, 2019, now Pat. No. 10,641,050.

(51) Int. Cl.

| | |
|---|---|
| ***E21B 17/02*** | (2006.01) |
| ***E21B 47/13*** | (2012.01) |
| ***E21B 17/046*** | (2006.01) |
| ***E21B 17/042*** | (2006.01) |

(52) U.S. Cl.

CPC ..... *E21B 17/0285* (2020.05); *E21B 17/046* (2013.01); *E21B 47/13* (2020.05); *E21B 17/042* (2013.01)

(58) Field of Classification Search

CPC ..... E21B 17/0285; E21B 17/003

See application file for complete search history.

(56) References Cited

U.S. PATENT DOCUMENTS 1,110,947 A * 9/1914 Lampert ..... F16L 25/026 264/261

2,364,957 A * 12/1944 Norvel ..... E21B 47/125 331/65

(Continued)

*Primary Examiner* — Blake Michener

(74) *Attorney, Agent, or Firm* — Morgan, Lewis & Bockius LLP

(57) ABSTRACT

A gap sub uses a plurality of insulating members in conjunction with at least two metallic members to effect a mechanically and electrically robust configuration. The gap sub includes an upper end portion, a lower end portion, an outer sleeve, an inner sleeve, an insulating outer washer, an insulating inner washer, and an insulating spider. The insulating outer washer is configured to transfer a first axial load between the upper end portion and the outer sleeve. The insulating inner washer is configured to transfer a second axial load between the inner sleeve and the lower end portion. The insulating spider is configured to transfer a torsional load between outer sleeve and the inner sleeve. Because the insulating washers are utilized to transfer axial loads and the insulating spider is utilized to transfer torsional loads, each insulator may be manufactured so that the strongest axis of the material can be optimally and advantageously oriented to be coincident with the forces applied to each insulator, thereby making the gap sub more mechanically robust than a conventional insulated gap collar while permitting reliable and fast transmission of sensor data to the surface.

9 Claims, 9 Drawing Sheets

(56) References Cited

U.S. PATENT DOCUMENTS

| | | | | |
|---|---|---|---|---|
| 4,348,672 | A * | 9/1982 | Givler | E21B 17/16 175/320 |
| 4,496,174 | A * | 1/1985 | McDonald | F16L 37/2445 285/55 |
| 6,050,353 | A * | 4/2000 | Logan | F16L 25/02 175/320 |
| 6,064,210 | A * | 5/2000 | Sinclair | G01V 3/20 324/369 |
| 7,252,160 | B2 * | 8/2007 | Dopf | E21B 47/017 175/320 |
| 10,221,632 | B2 * | 3/2019 | Macdonald | E21B 47/13 |
| 10,246,947 | B2 * | 4/2019 | Danov | H01G 2/106 |
| 10,822,884 | B1 * | 11/2020 | Bargach | E21B 47/13 |
| 2002/0113432 | A1 * | 8/2002 | Dopf | F16L 25/021 285/48 |
| 2004/0206510 | A1 * | 10/2004 | Fraser | F16L 25/021 166/65.1 |
| 2005/0068703 | A1 * | 3/2005 | Dopf | F16L 25/021 361/66 |
| 2013/0043874 | A1 * | 2/2013 | Clark | E21B 10/00 324/369 |
| 2014/0131994 | A1 * | 5/2014 | Holmen | F16L 25/021 285/47 |
| 2015/0013963 | A1 * | 1/2015 | McGarian | E21B 17/16 166/65.1 |
| 2015/0211307 | A1 * | 7/2015 | Minosyan | E21B 17/003 166/66 |
| 2015/0330155 | A1 * | 11/2015 | Logan | F16L 15/08 166/242.6 |
| 2015/0337604 | A1 * | 11/2015 | Archuleta | E21B 47/13 166/65.1 |

* cited by examiner

DATA TRANSMISSION SYSTEM

TECHNICAL FIELD

The present disclosure relates generally to data transmission systems, and more particularly, to electromagnetic (EM) data transmission systems for use within wellbores.

BACKGROUND

Wells are drilled to facilitate the extraction of hydrocarbons from a formation. During the drilling of a well, various drilling parameters can be monitored to adjust and optimize drilling operations. For example, sensors may be utilized to monitor parameters for steering a drill bit, measurements for the optimization of drilling efficiency, formation electrical resistivity, downhole pressure, direction and inclination of the drill bit, torque on bit, weight on bit, etc. During operation, sensor readings or data from the downhole sensors can be transmitted to the surface for monitoring, analysis, decision-making, and otherwise controlling drilling operations.

Drilling systems can transmit data from downhole sensors to a surface location for the above-mentioned purposes. For example, a drilling system can transmit data from a downhole location by introducing an electrical gap between the two ends of the drill string and emitting an electric field from the gap to transmit data to the surface. However, one drawback of conventional EM data transmission systems is that introducing an electrical gap into the drill string mechanically weakens the drill string, as the electrical gap is often created by sandwiching insulating materials between two separate metallic sections of one or more drill collars. During operation, the insulating material may be subject to torsional, compressional, and cyclical bending stresses under load. In some applications, low modulus insulating materials can plastically deform over time, while high modulus insulating materials may fracture, with both failures causing mechanical and/or electrical failure of the gap.

Further, EM data transmission systems may transmit at a low broadcast signal strength when operated on batteries, causing susceptibility to electrical noise that interferes with the detection and demodulation of the surface signal. Compounded with mechanical and/or electrical failure of the gap, as described above, battery operation can result in a severe reduction in transmitted signal strength. Therefore, what is needed is an apparatus, system or method that addresses one or more of the foregoing issues, among one or more other issues.

SUMMARY OF THE INVENTION

A gap sub is disclosed that uses a plurality of insulating members in conjunction with at least two metallic members to effect a mechanically and electrically robust configuration. The gap sub includes an upper end portion, a lower end portion, an outer sleeve, an inner sleeve, an insulating outer washer, an insulating inner washer, and an insulating spider. The outer sleeve includes a plurality of outer blades extending radially inward from an inner diameter of the outer sleeve. The inner sleeve includes a plurality of inner blades extending radially outward from an outer diameter of the inner sleeve and disposed at least partially between the plurality of outer blades. The insulating outer washer is configured to transfer a first axial load between the upper end portion and the outer sleeve. The insulating inner washer is configured to transfer a second axial load between the inner sleeve and the lower end portion. The insulating spider is configured to transfer a torsional load between the plurality of outer blades and the plurality of inner blades. Further, the upper end portion is electrically insulated from the lower end portion. Because the insulating washers are utilized to transfer axial loads and the insulating spider is utilized to transfer torsional loads, each insulator may be manufactured so that the strongest axis of the material can be optimally and advantageously oriented to be coincident with the forces applied to each insulator, thereby making the gap sub more mechanically robust than a conventional insulated gap collar while permitting reliable and fast transmission of sensor data to the surface. It should be understood that the terms upper and lower as used in this description are used for convenience and may be swapped without loss of performance or functionality.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1A:
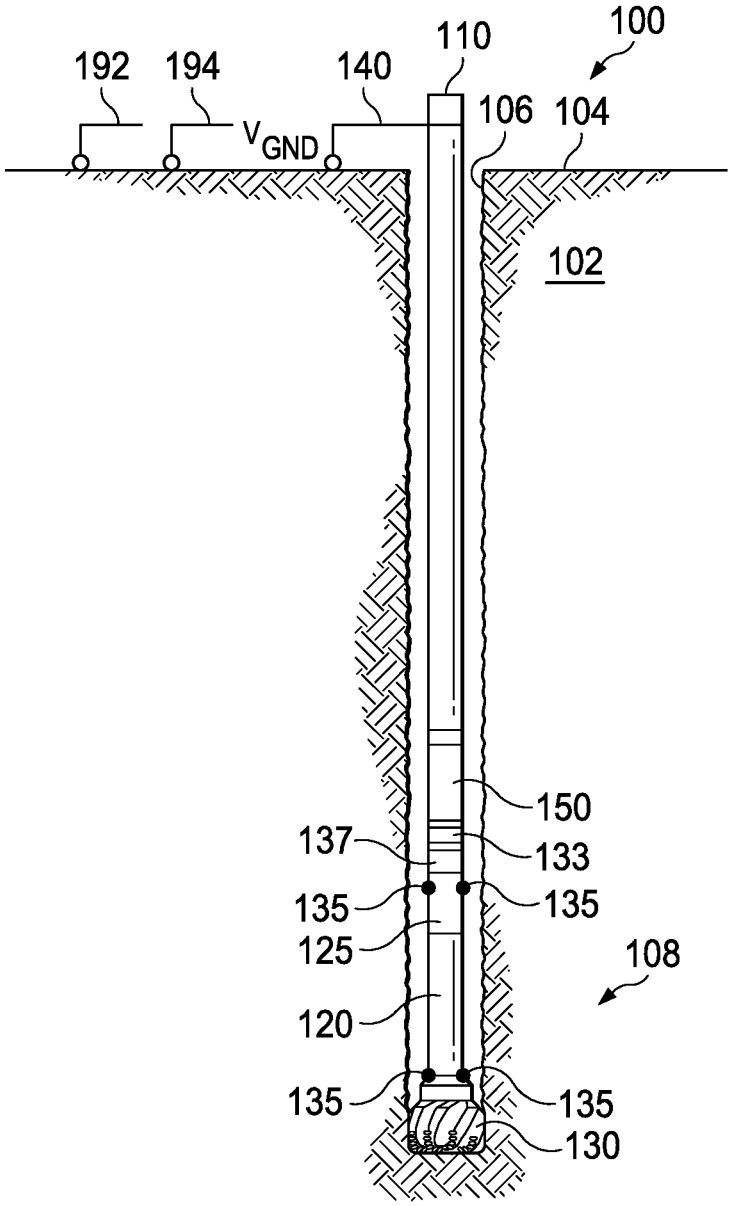
FIG. 1A is a schematic view of a drilling system, with a gap sub located uphole from a mud motor.
Figure 1B:
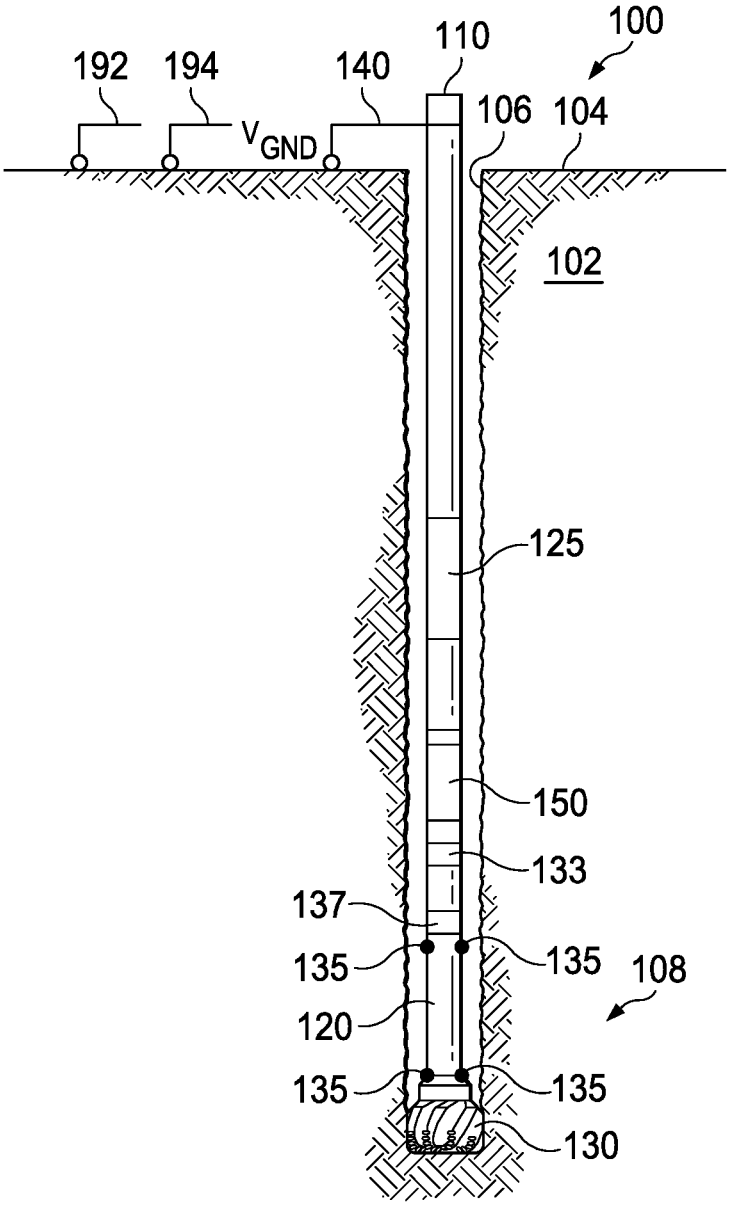
FIG. 1B is a schematic view of a drilling system, with a gap sub located downhole from a mud motor.

FIGS. 1A and 1B are schematic views of a drilling system 100. In the depicted example, the drilling system 100 can be utilized to drill a wellbore 106 through a formation 102 and can facilitate the transmission of telemetry information from a downhole location 108 to a surface location 104 for logging and real-time control of drilling operations.

As illustrated, a drill bit 130 coupled to a downhole end of a drill string 110 can be rotated within the formation 102 to form the wellbore 106. During the drilling operation, the drill string 110 can extend within the wellbore 106 from the surface location 104 to the downhole location 108. As can be appreciated, the drilling system 100 can form vertical wells, horizontal wells, lateral wells, and/or utilize directional drilling techniques.

In some embodiments, various sensors 135 disposed within or along the drill string 110 can be used to measure and observe parameters at the drill bit 130 or generally at the downhole location 108. In the depicted example, the drill string 110 can include sensors 135 and other electronics within a bottom hole assembly (BHA) 120 disposed at a downhole end of the drill string 110. In some embodiments, the bottom hole assembly 120 is coupled to the drill string 110 and/or the drill bit 130.

In some applications, the sensors 135 can be configured to detect drilling parameters related to directional drilling systems, such as rotary steerable collars, measurements for the optimization of drilling efficiency, electrical resistivity of the formation 102, etc. Optionally, sensors can be configured to detect torque on bit, weight on bit, or other drilling parameters. In some applications, the sensors can be located near the drill bit 130, allowing for the sensors more accurately determine the conditions at the drill bit 130.

During operation, a gap sub 150 can transmit via transmitter 137 sensor information from the sensors 135 disposed within the bottom hole assembly 120 (and other locations within the drill string 110) to a remote location. In the depicted example, the gap sub 150 can be disposed within the drill string 110 and offset from the bottom hole assembly 120. In some embodiments, the gap sub 150 can be integrated with or otherwise included within the bottom hole assembly 120.

As illustrated, the gap sub 150 can be disposed near the downhole end of the drill string 110. For example, as shown in FIG. 1A the gap sub 150 can be disposed uphole from mud motor 125. As shown in FIG. 1B, the gap sub 150 can be disposed downhole from mud motor 125, for example at a location between a mud motor and the bottom hole assembly 120. During operation, the mud motor can rotate an output shaft relative to a mud motor stator to rotate the drill bit 130. Advantageously, by positioning the gap sub 150 downhole of the mud motor, the drilling system 100 can eliminate the need for transmitting data across the mud motor using short hop telemetry systems.

As described herein, the gap sub 150 can transmit, via transmitter 137, sensor information using electro-magnetic signals or fields (EM telemetry). To facilitate EM telemetry, the gap sub 150 electrically isolates the top portion of the drill string 110 from the bottom portion of the drill string 110. During transmission, the gap sub 150 can emit a modulated electro-magnetic signal corresponding to the sensor data, creating an electric and magnetic field from the gap sub 150. In some embodiments, the gap sub 150 can include and/or be operatively coupled to a power source 133, such as batteries or a turbine driven downhole alternator and power supply.

Optionally, the top portion of the drill string 110 can be electrically connected to a ground stake 140 to form an antenna, allowing a receiver electrode 194 spaced some distance from the ground stake to receive the signal from the gap sub 150, which is then decoded and/or demodulated. In some embodiments, the gap sub 150 can transmit sensor information to a pair of receiver electrodes 192, and 194, disposed at the surface location 104.

Figure 2A:
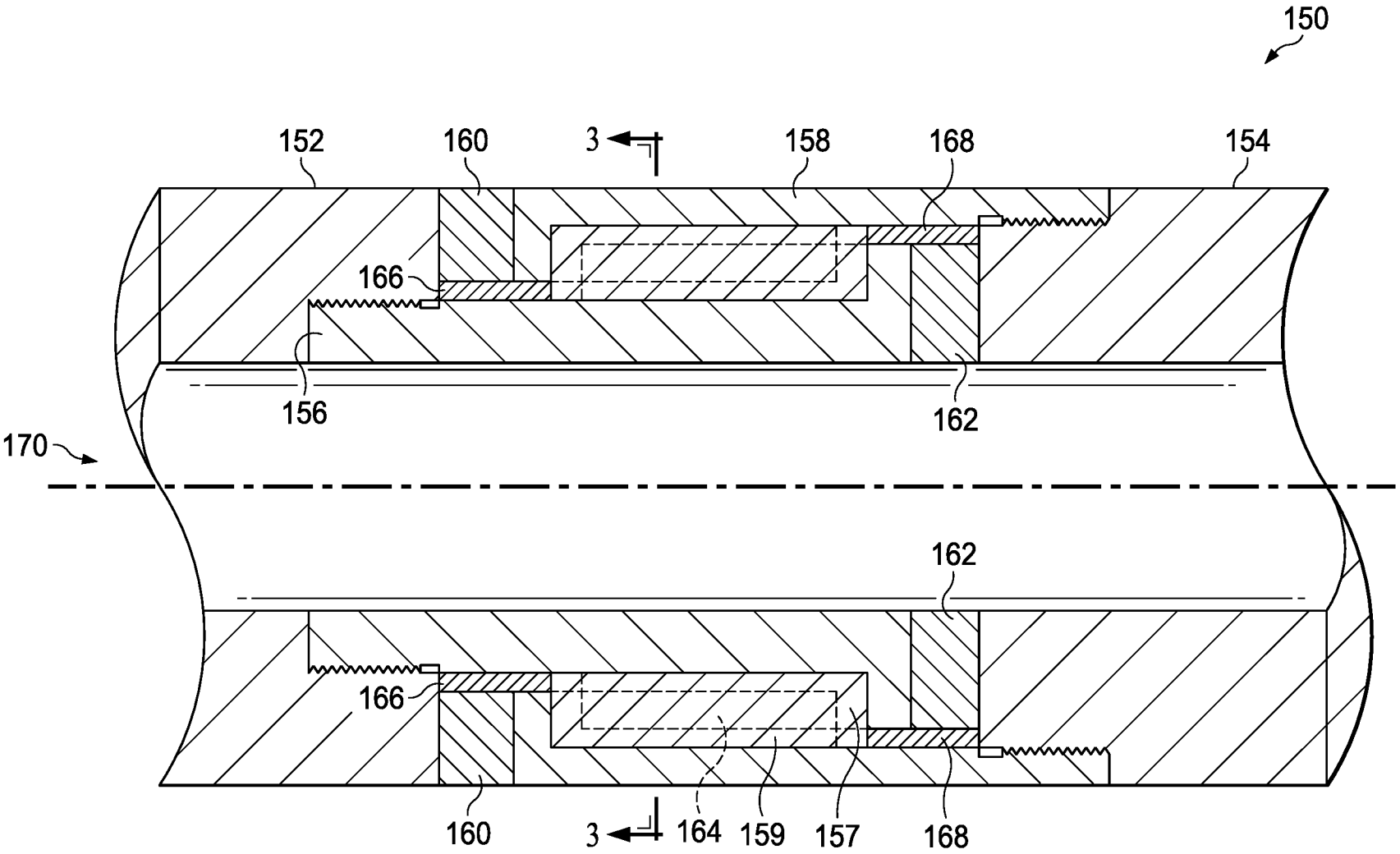
FIG. 2A is a cross-sectional view of a gap sub for use with the drilling system of FIG. 1A or 1B.

FIG. 2 is a cross-sectional view of a gap sub 150 for use with the drilling system 100 of FIG. 1. In the depicted example, the gap sub 150 creates an insulating gap for electrical isolation while permitting the effective transfer of compressional and torsional loads across the drill string 110. As can be appreciated, the insulating gap of the gap sub 150 can electrically isolate an upper end 152 from a lower end 154.

As described herein, the upper end 152 and the lower end 154 of the gap sub 150 can be coupled to other components of the drill string 110. The upper end 152 and the lower end 154 of the gap sub 150 may be a continuation of longer drill collar elements or may be collars coupled using threaded joints, box connections, pin connections, or other suitable connections. As illustrated, the gap sub 150 includes an outer sleeve 158 and an inner sleeve 156, wherein the upper end 152, the lower end 154, the outer sleeve 158, and the inner sleeve 156 collectively define the mud bore 170 therethrough. In some embodiments, the inner sleeve 156 at least partially axially overlaps with the outer sleeve 158. In some applications, the upper end 152, the lower end 154, the inner sleeve 156, and the outer sleeve 158 of the gap sub 150, along with other components of the drill string 110 can be formed from conductive materials such as steels, other metals, or other metal alloys. It should be clear from FIG. 2 that outer sleeve 158 and inner sleeve 156 form "a catch" and will not pass through each other should spider 164 mechanically fail. In that case, outer sleeve 158 would be pulled by the BHA above 154 in an uphole direction and inner sleeve 156 would be pulled by the BHA below 152 in a downhole direction until 158 and 156 come into physical contact. This is an important safety feature to allow the BHA to be pulled out of the hole should one or more gap insulators fail mechanically.

As described herein, the gap sub 150 can effectively isolate the upper portion of the drill string 110 coupled to the upper end 152 from the lower portion of the drill string 110 coupled to the lower end 154. As illustrated, the gap sub 150 utilizes insulating materials to electrically isolate the upper end 152 from the lower end 154. For example, the gap sub 150 can include isolating components such as an outer washer 160, an inner washer 162, and/or a spider 164 formed from insulating materials disposed between the upper end 152 and the lower end 154 to prevent the conduction of electricity therebetween. In conventional applications, certain insulating materials may not be able to adequately transfer the combination of axial and/or torsional loads that typically may be experienced by a conventional gap sub, limiting the performance and operation of a drill string 110 that includes a conventional arrangement of insulating materials in a conventional gap sub.

Advantageously, the gap sub 150 includes a construction and geometry that allows for the generally separate transfer of axial and torsional loads by separate insulating members, each optimized to transmit either axial or torsional forces in a specific orientation. For example, in some embodiments, the construction and geometry of the gap sub 150 allows for axial loads to generally be transferred through the gap sub 150 by the outer washer 160 and the inner washer 162, while minimizing torsional loading of the outer washer 160 and the inner washer 162. Similarly, the construction and geometry of the gap sub 150 can allow for torsional loads to generally be transferred through the gap sub 150 by the spider 164 while minimizing axial loading of the spider 164. Therefore, the combination of the outer washer 160, the inner washer 162, and the spider 164 along with the configuration of the inner sleeve 156 and the outer sleeve 158 can cooperatively transfer the combination of axial and torsional loads across the gap sub 150.

In the depicted example, the gap sub 150 includes an outer washer 160 to carry or transfer a compressional or axial load across an outer diameter of the gap sub 150. Similarly, the gap sub 150 can include an inner washer 162 to carry or transfer a compressional or axial load across the inner diameter of the gap sub 150. The outer washer 160 and/or the inner washer 162 can be configured to transfer minimal to no torsional load across the gap sub 150.

In some embodiments, the outer washer 160 is axially disposed between the upper end 152 and the outer sleeve 158. The outer washer 160 can have a generally annular shape or any other suitable shape. During operation, the outer washer 160 can transfer an axial load between the upper end 152 and the outer sleeve 158. In some embodiments, the outer washer 160 can abut against the upper end 152 and the outer sleeve 158 without a threaded connection therebetween.

Similarly, the inner washer 162 is axially disposed between the inner sleeve 156 and the lower end 154. The inner washer 162 can have a generally annular shape or any other suitable shape. During operation, the inner washer 162 can transfer an axial load between the inner sleeve 156 and the lower end 154. In some embodiments, the inner washer 162 can abut against the inner sleeve 156 and the lower end 154 without a threaded connection therebetween.

In some applications, compressional load between the upper end 152 and the lower end 154 of the gap sub 150 can be transmitted by the outer sleeve 158 and the inner sleeve 156 in parallel. For example, an outer diameter (OD) or outer compressional path can comprise a compressional load supported by the upper end 152, the outer washer 160, the outer sleeve 158, and the lower end 154. Optionally, the outer sleeve 158 can be coupled to the lower end 154 via a threaded connection or any other suitable connection. Similarly, an inner diameter (ID) or inner compressional path can comprise a compressional load supported by the upper end 152, the inner sleeve 156, the inner washer 162, and the lower end 154. Further, the inner sleeve 156 can be coupled to the upper end 152 via a threaded connection or any other suitable connection.

In some applications, the strain experienced by both compressional paths of the gap sub 150 can be equalized to minimize any differential compressional stress (e.g. during the application of weight-on-bit), minimizing compressional loading of the spider 164 due to unequal strains. Therefore, in some embodiments, the axial cross-sectional area of the outer sleeve 158 can be the same or similar as the axial cross-sectional area of the inner sleeve 156. Similarly, the axial cross-sectional area of the outer washer 160 and the inner washer 162 can be the same or similar. Further, the axial cross-sectional area of the outer washer 160 and the inner washer 162 can be selected to withstand applied stresses (such as from excessive weight-on-bit) without exceeding the rated yield strength of the insulating washer material.

In the depicted example, the outer washer 160 and/or the inner washer 162 can be formed from any suitable insulating material, including materials suitable for withstanding axial or compressive loading. Advantageously, by separating torsional and compressional loading, the outer washer 160 and/or the inner washer 162 formed from high modulus materials are thereby less susceptible to fracturing and/or formed from low modulus materials are thereby less susceptible to plastic deformation. For example, the outer washer 160 and/or the inner washer 162 can be formed from high modulus ceramic materials, including, but not limited to, Silicon Nitride 240, etc. Further, the outer washer 160 and/or the inner washer 162 can be formed from low modulus composite materials, including, but not limited to, epoxy fiberglass, high strength fiber-loaded thermoplastics, etc. In some embodiments, low modulus materials, in addition to any fibrous materials, can include metallic structures or skeletons to provide additional mechanical strength to the outer washer 160 and/or the inner washer 162. As can be appreciated, the metallic structure within the material can be potted inside the material to maintain the insulating properties of the member. In yet another embodiment, the insulating material may be bonded directly to a thin load bearing metallic face on one side or the other or both to better distribute any uneven loads that may result from mechanical variations in the load bearing faces of the inner or outer sleeves and the upper or lower ends of the gap. Any metallic faces so used must be configured so as not to provide a parasitic electrical path that electrically bypasses any of the gap insulators, thereby destroying the operation of the gap.

Figure 2B:
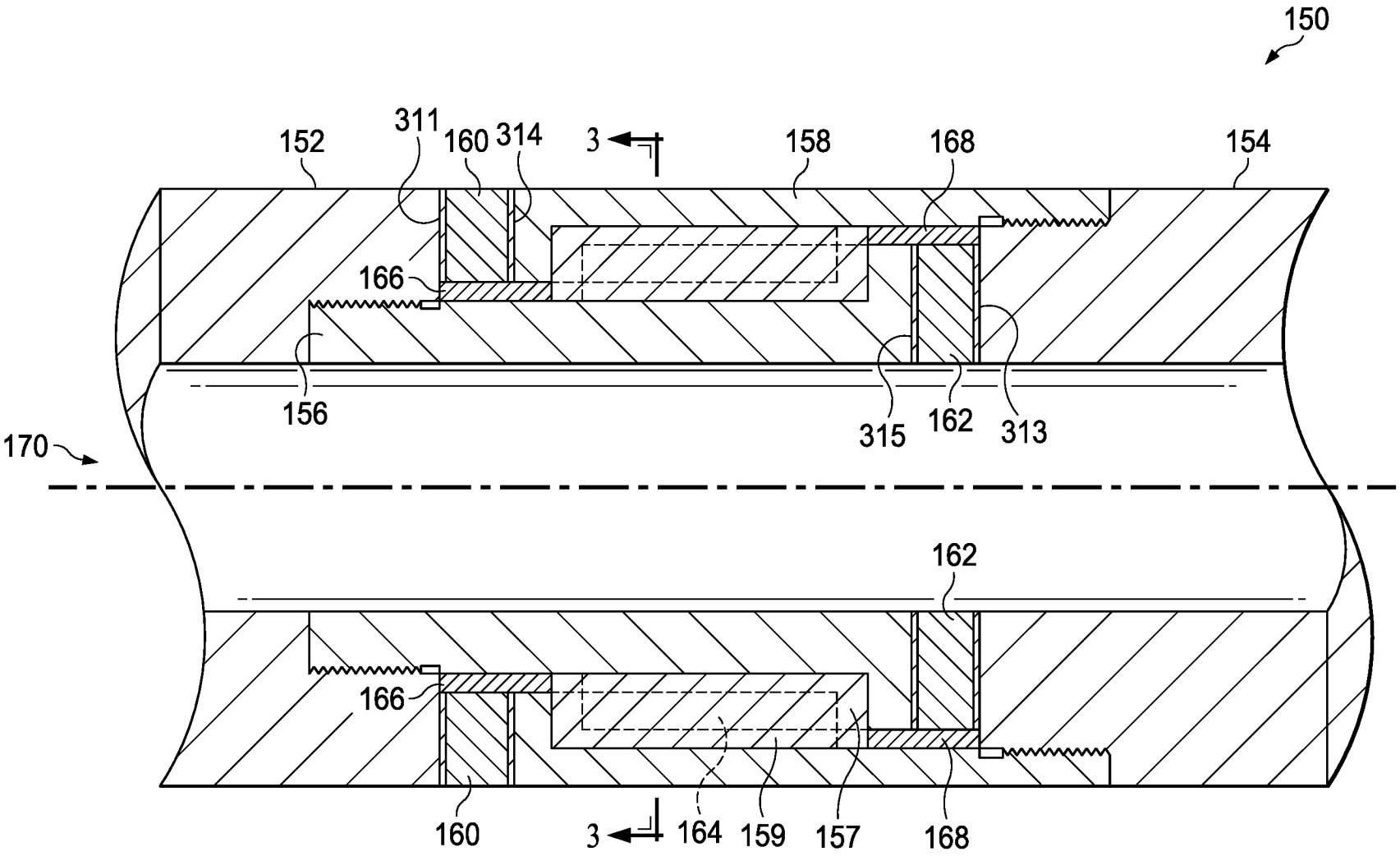
FIG. 2B is a cross-section view of the gap sub of FIG. 2A with metallic faces bonded to the inner and outer washers.

As shown in FIG. 2B, outer washer 160 may be bonded to upper metallic face 311, lower metallic face 314, or both. Similarly, inner washer 162 may be bonded to upper metallic face 315, lower metallic face 313, or both. As will be appreciated by one of ordinary skill in the art, bonding outer washer 160 or inner washer 162 to one or more metallic faces will increase the mechanical durability of these components.

Figure 3:
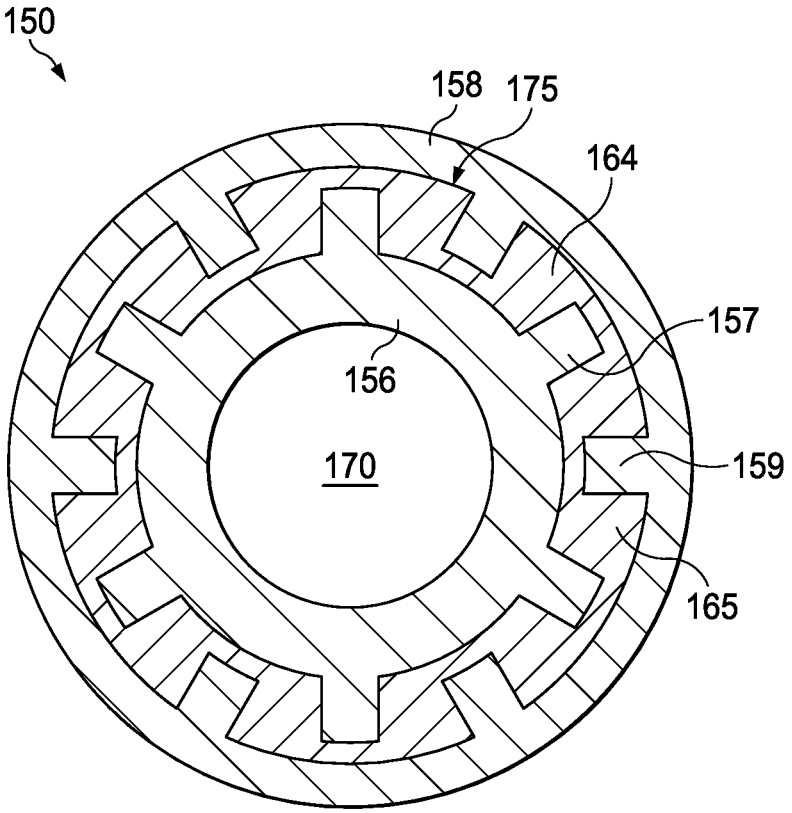
FIG. 3 is a cross-sectional view of the gap sub of FIG. 2A at section line 3-3.

FIG. 3 is a cross-sectional view of the gap sub 150 of FIG. 2 at section line 3-3. With reference to FIGS. 2 and 3, the gap sub 150 includes a spider 164 to carry or transfer a torsional load across the gap sub 150. Advantageously, as the outer washer 160 and the inner washer 162 support the axial or compressive load through the gap sub 150, the spider 164 may not experience significant axial or compressive loading (e.g., due to weight-on-bit) during operation.

In the depicted example, the spider 164 is disposed in the annulus 175 defined by the outer sleeve 158 and the inner sleeve 156 to transmit torque or torsional load therebetween, thereby preventing rotation of the outer sleeve 158 relative to the inner sleeve 156 and vice versa. In some embodiments, the spider material 165 can extend along a portion or all of the axial length of the outer sleeve 158 and/or the inner sleeve 156. As illustrated, the spider 164 can be axially disposed between the outer washer 160 and the inner washer 162.

As illustrated, the outer sleeve 158 engages with the spider 164 via a plurality of outer blades 159 that extend radially inward into the spider material 165. As shown, the plurality of outer blades 159 can extend from the inner diameter of the outer sleeve 158. Similarly, the inner sleeve 156 engages with the spider 164 via a plurality of inner blades 157 that extend radially outward into the spider material 165. As shown, the plurality of inner blades 157 can extend from the outer diameter of the inner sleeve 156. In some embodiments, the plurality of outer blades 159 and/or the plurality of inner blades 157 can be circumferentially spaced apart. Optionally, the plurality of inner blades 157 can extend between the space between the plurality of outer blades 159 to at least partially radially overlap (as shown in FIG. 3). As illustrated, the plurality of outer blades 159 can be spaced apart or dimensioned to avoid contact with the plurality of inner blades 157 and/or the inner sleeve 156. Similarly, the plurality of inner blades 157 can be spaced apart or dimensioned to avoid contact with the plurality of outer blades 159 and/or the outer sleeve 158.

During operation, torsional load across the gap sub 150 can be transmitted by the spider 164. For example, torsional load path can comprise a torsional load supported by the upper end 152, the inner sleeve 156, the spider 164, the outer sleeve 158, and the lower end 154. As previously described, the inner sleeve 156 and the outer sleeve 158 can be coupled to the upper end 152 and the lower end 154, respectively, via a threaded connection or any other suitable connection. As can be appreciated, the plurality of inner blades 157 and the plurality of outer blades 159 in engagement with the spider 164 allow for torsional load to be transmitted between the inner sleeve 156 and the outer sleeve 158 while minimizing shear forces on the spider material 165. Further, the area of overlap between the plurality of inner blades 157 and the plurality of outer blades 159 can be selected to withstand applied stresses (such as from excessive applied torque during drilling) without exceeding the rated yield strength of the insulating spider material 165.

In the depicted example, the spider material 165 can comprise any suitable insulating material, including materials suitable for withstanding torsional loading. Advantageously, by separating torsional and compressional loading, the spider material 165 can comprise high modulus materials that are therefore less susceptible to fracturing and/or comprise low modulus materials that are therefore less susceptible to plastic deformation. For example, the spider material 165 can comprise high modulus ceramic materials, including, but not limited to, Silicon Nitride 240, etc. Further, the spider material 165 can comprise low modulus composite materials, including, but not limited to, epoxy fiberglass, high strength fiber-loaded thermoplastics, etc. In some embodiments, low modulus materials, in addition to any fibrous materials, can include metallic structures or skeletons to provide additional mechanical strength to the spider 164. As can be appreciated, the metallic structure within the material can be potted inside the material to maintain the insulating properties of the member. In yet another embodiment, the insulating material may be bonded directly to a thin load bearing metallic face on one side or the other or both of the spider to better distribute any uneven loads that may result from mechanical variations in the load bearing faces of the inner or outer sleeves of the gap. Any metallic faces so used must be configured so as not to provide a parasitic electrical path that electrically bypasses any of the gap insulators, thereby destroying the operation of the gap. It should be understood that to facilitate the fabrication of the spider and/or to minimize any susceptibility to fracturing or plastic deformation that it can be comprised of a single piece of insulating material or it can be comprised of several axial sections that are stacked in series with each other or it can be comprised of several azimuthal sections that together form a complete spider subassembly.

Optionally, the gap sub 150 can include sealing members, such as bushings, to prevent the migration of mud or other fluids from the mud bore 170 through the gap sub 150. For example, as shown in FIG. 2, a bushing 166 can be disposed between the outer sleeve 158, the inner sleeve 156, and/or the outer washer 160. Similarly, bushing 168 can be disposed between the outer sleeve 158, the inner sleeve 156, and/or the inner washer 162. In some embodiments, the bushings 166, 168 can comprise rubber or other elastomeric materials, including, but not limited to, Viton® or Calraz®. Further, threaded connections, such as the threaded connection between the upper end 152 and the inner sleeve 156 and/or the threaded connection between the outer sleeve 158 and the lower end 154, can utilize a thread locking and/or sealing compound to similarly prevent the migration of mud or other fluids.

In some embodiments, the gap sub 150 can be used in conjunction with downhole power generation mechanisms, such as an alternator assembly with a suitable power supply to advantageously provide significantly more power (voltage and current) and for a longer period of time (duration) relative to the power and duration available from downhole batteries. This allows for an increase in broadcast signal levels, enabling an increase in the frequency of transmission for higher data rates with good signal to noise ratios on the surface, allowing for signals transmitted from the gap sub 150 to be more robustly detected and demodulated at the surface compared with using batteries with limited capacity. Downhole power generation mechanisms provide a significant advantage over existing downhole technology, namely, addressing the several limitations of battery powered operation, namely, signal strength, duration of operation, cost of battery replacement, and ecologically sound battery disposal.

As can be appreciated, the gap sub 150 can be assembled utilizing any suitable procedure and/or sequence. By way of non-limiting example, steps of assembly can include first mounting the spider 164 onto the inner sleeve 156. Then, a bushing 168 can be positioned onto a lower portion of the inner sleeve 156, and a bushing 166 positioned around an upper portion of the inner sleeve 156, proximate to the spider 164. Next, the outer sleeve 158 is positioned over the spider 164 and the bushing 166. Then, the inner washer 162 and the outer washer 160 are mounted onto the gap sub 150 and the lower end 154 and the upper end 152 are threadedly coupled to the outer sleeve 158 and the inner sleeve 156, respectively.

The upper end 152 and the lower end 154 are then torqued to a preselected torque specification, preloading the internal mating surfaces of the gap sub 150. As a result of the preloading procedure, the spider 164, the outer washer 160, and the inner washer 162 may be axially preloaded. As can be appreciated, the axial (compressional) cross-sectional area of the spider 164 can be selected to withstand the relatively small axial preload imparted during assembly.

Figure 4A:
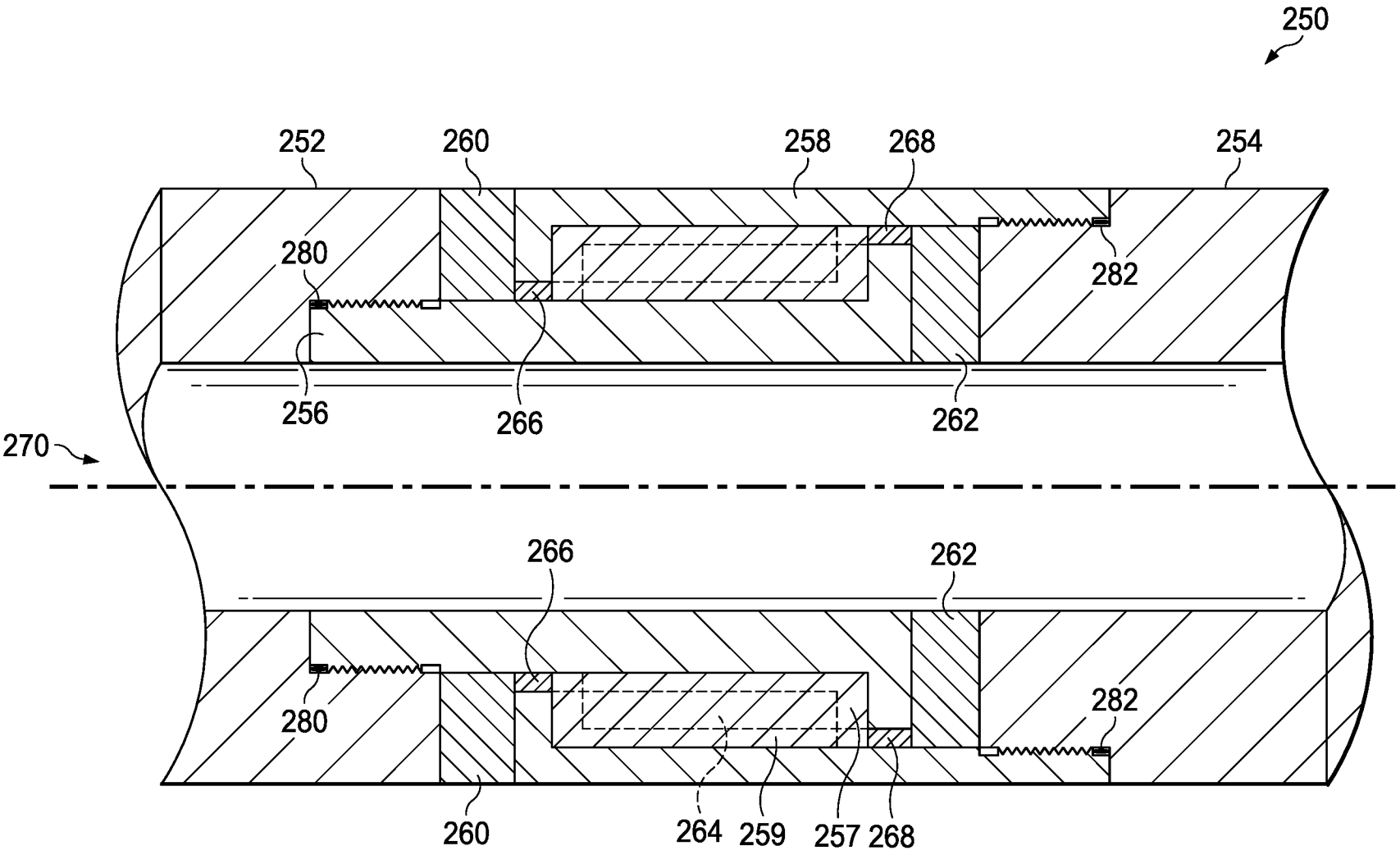
FIG. 4A is a cross-sectional view of a gap sub for use with the drilling system of FIG. 1A or 1B.

FIG. 4 is a cross-sectional view of a gap sub 250 for use with the drilling system of FIG. 1. The gap sub 250 is similar to gap sub 150 illustrated and described with respect to FIG. 2. Unless noted, similar elements are referred to with similar reference numerals.

Optionally, the gap sub 250 includes O-rings 280, 282 to prevent the migration of mud or other fluids from the mud bore 170 through the gap sub 150. In the depicted example, the O-ring 280 is disposed at the threaded connection between the upper end 252 and the inner sleeve 256. Similarly, the O-ring 282 can be disposed at the threaded connection between the outer sleeve 258 and the lower end 254. In some embodiments, the O-rings 280, 282 can comprise rubber or other elastomeric materials, including, but not limited to, Viton or Calraz.

Figure 4B:
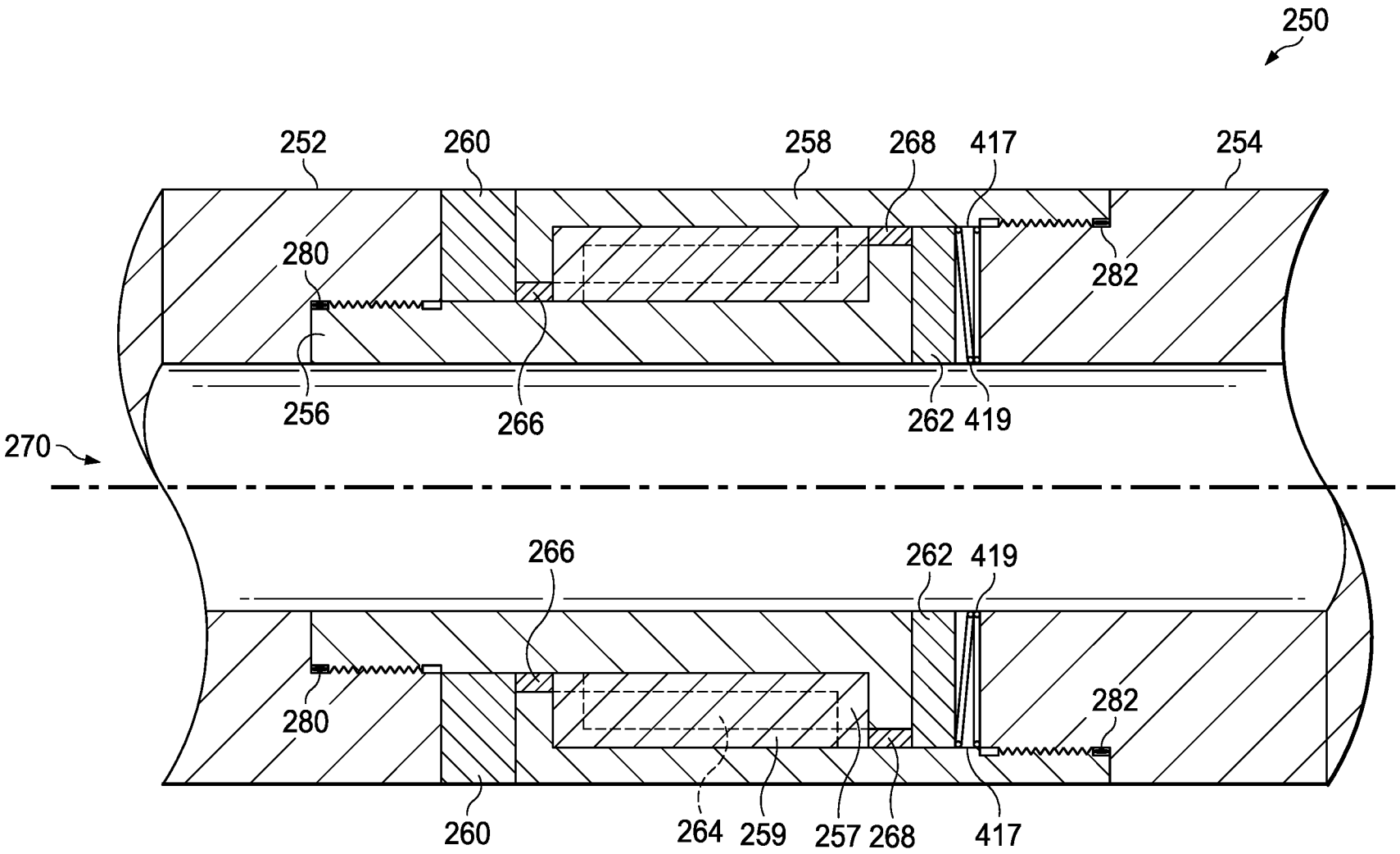
FIG. 4B is a cross-sectional view of an alternate embodiment of the gap sub of FIG. 3.

FIG. 4B shows a section of yet another embodiment of a gap sub 250 for use with the drilling system of FIG. 1. The axial compressional force preloading the spider 264 applied by the outer sleeve 258 as it is being threaded onto the lower end 254 is controlled and moderated by one or more Bellville washers 419 disposed between inner washer 262 and lower end 254. A metallic washer and cup 417 may also be disposed between Belleville washer 419 and inner washer 262 to evenly distribute the force from the Bellville washers 419. A similar arrangement, not shown, could be implemented at the interface between upper end 252 and outer washer 260 to limit the axial compressional force preloading the spider 264, applied by the inner sleeve 256 as it threads into the upper end 252. One of ordinary skill in the art will understand that an alternative biasing member, such as a spring, could be employed instead of a Belleville washer.

Figure 5:
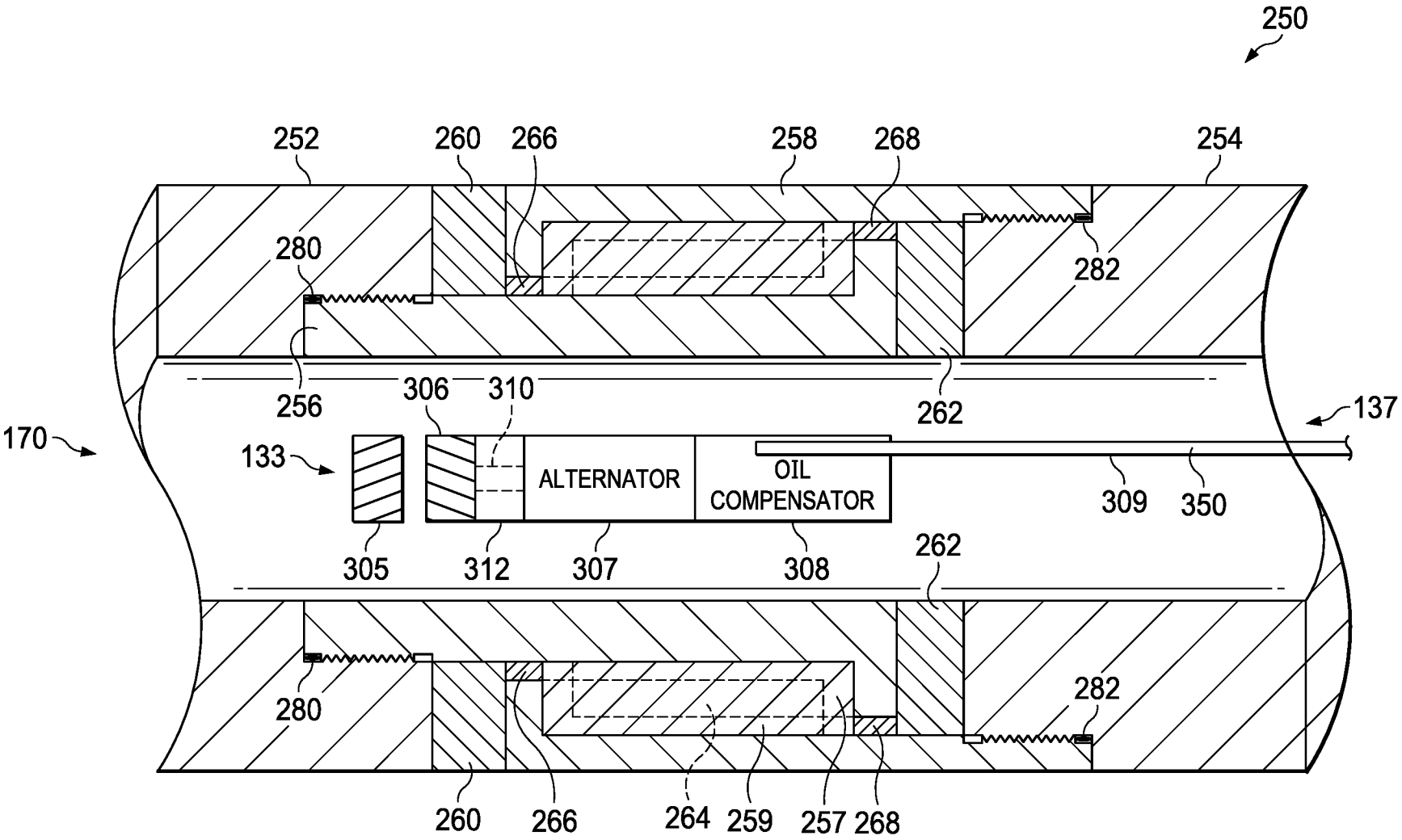
FIG. 5 is a cross-section view of one embodiment of a downhole power source.

FIG. 5 illustrates one embodiment of a power source 133. It comprises a turbine stator 305, and turbine rotor 306 coupled to the shaft 310 of an alternator 307 that can generate several hundred watts of power when mud is flowing through the bore 170. A hydraulic oil pressure compensator 308 pressure balances a rotating shaft seal 312 on the rotating shaft 310. Power from power source 133 may be transmitted to sensors 135 and/or transmitter 137 via wire tube 309. The benefits of downhole power generation include the ability to use higher transmitted power levels and the ability to operate for longer periods of time without depleting the downhole batteries.

Figure 6:
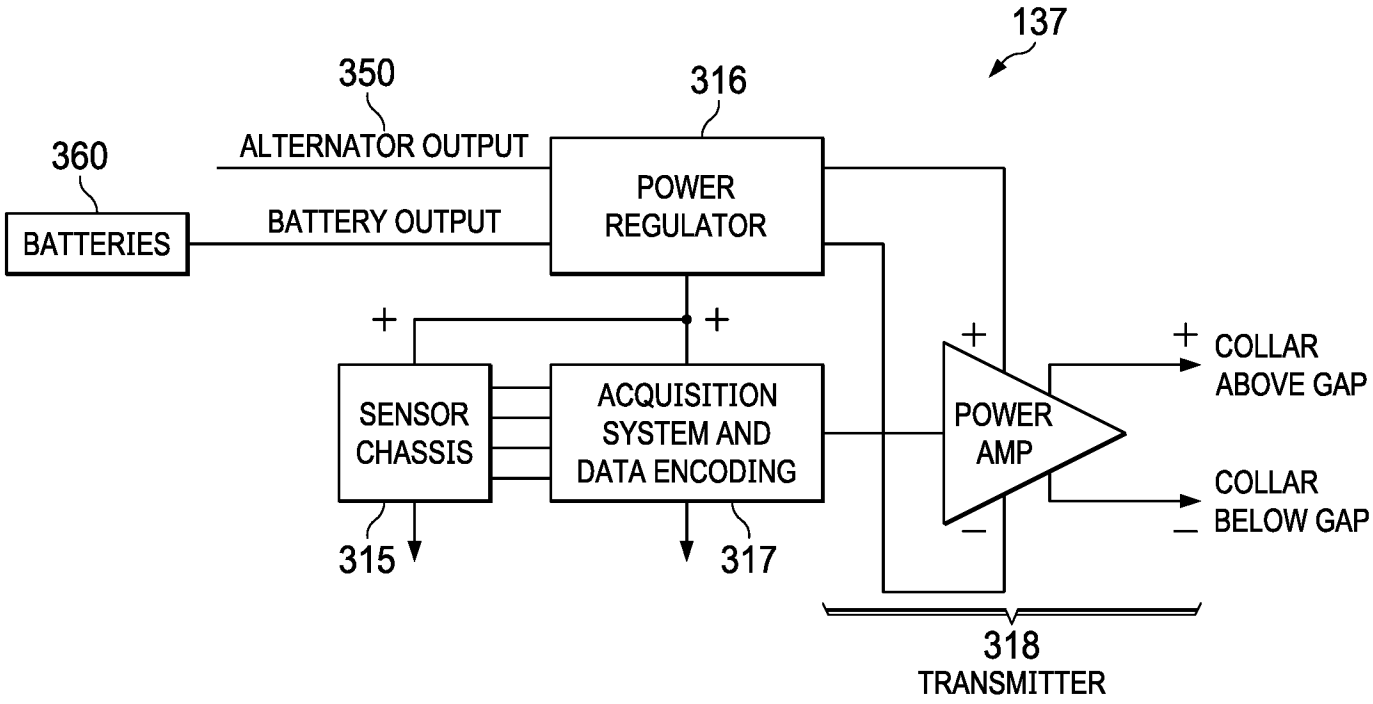
FIG. 6 is a schematic view of one embodiment of a sensor and transmitter module.

Transmitter 137 may also comprise sensors, as opposed to separate sensors 135 depicted in FIGS. 1A and 1B. FIG. 6 illustrates a schematic of such a sensor and transmitter module 137. When mud is flowing through bore 170, the turbine 306 will cause alternator 307 to generate voltage and current, supplied to the sensor and transmitter module 137 through wires 350. When there is no mud flowing, power will be supplied to the sensor and transmitter module from batteries 360. Module 137 is powered by power regulator 316. Power regulator 316 can consist of several power supplies, including a variable voltage high power supply that would drive the voltage difference across the gap. The voltage level could be adjusted to control the current flowing across the gap. The data from the downhole sensors 315 are acquired by the acquisition system and data encoding module 317. This will encode the sensor data into a telemetry frame and modulated voltage signal that will be supplied to the gap transmitter 318 which drives the two sides of the insulated gap sub with respect to each other. One side of transmitter power amp is connected to the upper end uphole from the gap and the other side is connected to the lower end 154 disposed downhole from the gap.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments. It is to be understood that mechanical design best practices require the use of generous radii on the sharp corners and edges of both metallic and insulating members to reduce stress concentrations to minimize susceptibility to fracturing, plastic deformation, and metal fatigue. These features do not affect the functional description of the gap are not included in the figures in the interest of clarity.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A gap sub, comprising:

an outer sleeve axially disposed between an upper end portion of a drill string and a lower end portion of a drill string, the outer sleeve comprising a plurality of outer blades extending radially inward from an inner diameter of the outer sleeve;

an inner sleeve axially disposed between the upper end portion of the drill string and the lower end portion of the drill string, and at least partially radially and axially overlapping with the outer sleeve, the inner sleeve comprising a plurality of inner blades extending radially outward from an outer diameter of the inner sleeve;

an annular cavity formed between the inner sleeve and outer sleeve;

an insulating outer washer axially disposed between the upper end portion of the drill string and the outer sleeve, wherein the insulating outer washer is configured to transfer a first axial load in a first direction between the upper end portion of the drill string and the outer sleeve;

an insulating inner washer axially disposed between the inner sleeve and the lower end portion of the drill string, wherein the insulating inner washer is configured to transfer a second axial load in the first direction between the inner sleeve and the lower end portion of the drill string; and an insulating spider:

disposed axially between, but physically separate from, the insulating outer washer and the insulating inner washer, such that:

the insulating spider is configured to transfer an axial load in a second direction from the inner sleeve to the outer sleeve and the upper end portion of the drill string is electrically insulated from the lower end portion of the drill string; and disposed within the cavity formed between the inner sleeve and the outer sleeve, such that the insulating spider is configured to transfer a torsional load between the plurality of outer blades and the plurality of inner blades.

2. The gap sub of claim 1, wherein at least one of the insulating outer washer and the insulating inner washer comprises an insulating material bonded to a metallic face.

3. The gap sub of claim 1, further comprising a biasing member disposed between the insulating inner washer and the lower end portion of the drill string.

4. The gap sub of claim 1, further comprising a biasing member disposed between the insulating outer washer and the upper end portion of the drill string.

5. A drilling system comprising:

a drill string configured to form a wellbore within a formation, the drill string comprising:

a drill pipe extending from a surface location to a downhole location within the wellbore;

a bottom hole assembly coupled to a downhole end of the drill pipe, wherein the bottom hole assembly comprises:

a drill collar;

at least one sensor operatively coupled to a transmitter; and a drill bit coupled to the drill collar; and a gap sub disposed along the drill string, the gap sub comprising:

an outer sleeve axially disposed between an upper end portion of a drill string and a lower end portion of a drill string, the outer sleeve comprising a plurality of outer blades extending radially inward from an inner diameter of the outer sleeve;

an inner sleeve axially disposed between the upper end portion of the drill string and the lower end portion of the drill string, and at least partially radially and axially overlapping with the outer sleeve, the inner sleeve comprising a plurality of inner blades extending radially outward from an outer diameter of the inner sleeve;

a cavity formed between the inner sleeve and outer sleeve;

an insulating outer washer axially disposed between the upper end portion of the drill string and the outer sleeve, wherein the insulating outer washer is configured to transfer a first axial load in a first direction between the upper end portion of the drill string and the outer sleeve;

an insulating inner washer axially disposed between the inner sleeve and the lower end portion of the drill string, wherein the insulating inner washer is configured to transfer a second axial load in the first direction between the inner sleeve and the lower end portion of the drill string; and an insulating spider:

disposed axially between, but physically separate from, the insulating outer washer and the insulating inner washer, such that:

the insulating spider is configured to transfer an axial load in a second direction from the inner sleeve to the outer sleeve and the upper end portion of the drill string is electrically insulated from the lower end portion of the drill string; and disposed within the cavity formed between the inner sleeve and the outer sleeve, such that the insulating spider is configured to transfer a torsional load between the plurality of outer blades and the plurality of inner blades; and wherein the gap sub is configured to allow transmission from a transmitter of an electromagnetic signal corresponding to sensor data.

6. The drilling system of claim 5, wherein the gap sub further comprises a biasing member disposed between the insulating inner washer and the lower end portion of the drill string.

7. The drilling system of claim 6, wherein the gap sub further comprises a biasing member disposed between the insulating outer washer and the upper end portion of the drill string.

8. The drilling system of claim 5, wherein the insulating material of the insulating inner washer is bonded to a metallic face.

9. The drilling system of claim 5, wherein the insulating material of the insulating outer washer is bonded to a metallic face.

* * * * *